US006082005A

United States Patent [19]

Tezuka

[11] Patent Number: 6,082,005

[45] Date of Patent: Jul. 4, 2000

[54] ELECTRIC SHAVER

[75] Inventor: Yoshitaka Tezuka, Tsuna-gun, Japan

[73] Assignee: Sanyo Electric Co., Ltd., Moriguchi, Japan

[21] Appl. No.: 09/177,048

[22] Filed: Oct. 23, 1998

[30] Foreign Application Priority Data

Oct. 30, 1997 [JP] Japan ..... 9-299087
Oct. 31, 1997 [JP] Japan ..... 9-301042

[51] Int. Cl.[7] ..... B26B 19/04

[52] U.S. Cl. ..... 30/43.92; 30/34.1

[58] Field of Search ..... 30/34.1, 43, 43.91, 30/43.92

[56] References Cited

U.S. PATENT DOCUMENTS

| | | | |
|---|---|---|---|
| 3,858,314 | 1/1975 | Brenneman et al. | 30/43.92 |
| 4,033,034 | 7/1977 | Imai et al. | 30/43.92 |
| 4,219,930 | 9/1980 | Franko et al. | 30/43.92 |
| 4,631,825 | 12/1986 | Kuriyama et al. | 30/43.92 |
| 4,805,300 | 2/1989 | Miska | 30/34.1 |
| 5,257,456 | 11/1993 | Franke et al. | 30/43.92 |
| 5,715,601 | 2/1998 | Nakatani et al. | 30/43.92 |
| 5,771,580 | 6/1998 | Tezuka | 30/43.92 |

FOREIGN PATENT DOCUMENTS

8404174 U1 5/1984 Germany .

*Primary Examiner*—Hwei-Siu Payer
*Attorney, Agent, or Firm*—Wenderoth, Lind & Ponack, L.L.P.

[57] ABSTRACT

The electric shaver is provided with outer blades, inner blades driven in reciprocating motion against the inner face of the outer blades and a driving mechanism driving the inner blades in reciprocating motion. The driving mechanism is provided with vibrating rods, which transmit the reciprocating motion and are connected at their extremities to the inner blades. Vibrators are connected to the vibrating rods and are mounted in a case. A reciprocating motion mechanism drives the vibrators in a reciprocating motion. The vibrating rods are connected to drive ports of the inner blades in a fashion allowing movement in an axial direction. Furthermore, blade-pushing springs, which permit the flexible reciprocating motion of the inner blades against the outer blades, are introduced on the vibrating rods such that the inner blades are pressed against the outer blades by the blade-pushing springs.

13 Claims, 16 Drawing Sheets

ELECTRIC SHAVER

BACKGROUND OF THE INVENTION

The present invention relates to an electric shaver which drives inner blades set inside of outer blades with reciprocating motion.

FIG. 1 and FIG. 2 are exploded perspective views showing a known electric shaver having inner blades which are movable with a reciprocating motion. In the electric shaver shown in FIGS. 1–2, inner blades 130 are connected to up-down rods 131 of inner blade stages 128, respectively. The inner blade stages 128 are mounted in blade support 132 to allow reciprocating motion via flexible arms 134 mounted at both ends of the plate 135 which supports inner blade stage 128. The blade support 132 is mounted to the outer blade frame 107 in a removable manner, then mounted to a shaver body 127 via the outer blade frame 107. When the inner blade stages 128 are mounted to the shaver body 127, the inner blade stages 128, which are connected to vibrator stages 117, housed-in the shaver body 127, move with reciprocating motion. That is to say, in the electric shaver having this structure, a motor 118 drives the vibrators 117 in reciprocating motion, the vibrators 117 drive the inner blade stages 128 in reciprocating motion, and the inner blade stages 18 drive the inner blades 130 in reciprocating motion. Namely, the vibrators 117 driven in reciprocating motion by the motor 118, drive the inner blades 130 in reciprocating motion via the inner blade stages 128.

The inner blades 130 need to be driven in reciprocating motion while being flexibly pressed against the inner face of the outer blade 129. It is necessary to ensure that the beard, which protrudes from beard cutting ports of the outer blade 129 into the inside, is cut by the reciprocating inner blades 130. In order to have the inner blades 130 move in the reciprocating motion along the inner face of the outer blades 129, each of the inner blade stages 128 comprises up-down rod 131. As shown in an exploded oblique view of FIG. 3, the up-down rods 131 are flexibly pushed upwards by built-in pressure springs 133. The pressure springs 133 are housed-in the up-down rods 131, and push the up-down rods 131 upward flexibly.

According to the present description, the up-down direction is determined by the vertical posture of the electric shaver as shown in FIG. 1.

Turning to FIG. 4, in order to connect the up-down rods 131 to the inner blades 130, the inner surface of inner blade supports 130A is configured to connect to the up-down rods 131. The inner blades 130, shown in an oblique view of FIG. 4, are integrally formed with connecting support struts 130B at the inner face of the inner blade supports 130A which are made of plastic. Since the connecting support strut 130B is inserted into the inside of the up-down rod 131, the connecting support struts 130B are designed with an external width which has substantially the same width as the internal side of the up-down rods 131.

Furthermore, each of the inner blade supports 130A has a pair of locking parts 130C formed at the inner face and protruding inside to prevent them from coming off the up-down rods 131. The locking parts 130C are positioned at the center of the inner blade support 130A, which has parallel plates to each other, and integrally formed at the lower edge. The locking parts 130C are guided into latching windows 131A formed in the up-down rods 131 when the inner blade 130 connects the up-down rods 131 so as to prevent the inner blade 130 from coming off the up-down rod 131. When the connecting support struts 130B of the inner blades 130 are inserted into the up-down rod 131 to connect them, the inner blade supports 130A, which have the shape of parallel plates, flexibly open the width between these parallel plates widely and the locking parts 130C are guided into the latching windows 131A of the up-down rods 131. After the locking parts 130C are guided into the locking windows 131A, then the width of the plates of the inner blade support 130A tend to recover its narrow width, and the locking parts 130C latch into the latching windows 131A.

As shown in FIGS. 4 and 5, each of inner blade stages 128 has driving pin 128A which protrudes downwards at the bottom thereof to connect with the vibrator of the shaver body. Each of the driving pins 128A is introduced into axis port 117*a*, provided at the center of the vibrator 117 as shown in FIG. 2, with no gap to connect to the vibrator 117. The axis port is configured with a tapered shape with a wider upper portion whereby the driving pin 128A is guided at the center portion.

The electric shaver with the above-mentioned structure mounts the inner blades so as to connect to the up-down rods of the inner blade stages in order that these inner blades are driven in an up-down motion by the up-down rods. The electric shaver of this structure needs to connect the inner blades to the vibrator via two parts, the up-down rod and the inner blade stage. Consequently the clearance between the inner blade and the up-down rod, the up-down rod and the inner blade stage, and the inner blade stage and the vibrator act to reduce the stroke driving the inner blades in reciprocating motion, and also cause disagreeable noise or shaking.

Further, with this structure, numerous parts are needed, and the structure connecting the inner blades to the vibrators becomes more complicated. In addition, if the quality of each manufactured part is low, then the clearance occurs and the above mentioned problems will happen. This is why a high level of quality of manufacturing each part is required, and this will cause a rise in production costs, or the assembly process takes more time, namely, the manufacturing cost is greater.

Furthermore, because the electric shaver of this structure moves the up-down rod with vertical strokes, there is another drawback in that it is difficult to augment the stroke span of the up-down rod. Further, if the stroke of the up-down rod is augmented, this part becomes higher and the overall length of the electric shaver becomes greater, and as a drawback, compactness cannot be maintained.

The present invention has been developed with the object to solve these drawbacks. The first object of the present invention is to offer an electric shaver with a simplified driving mechanism which drives the inner blades in reciprocating motion, allowing a lower price for mass production, and also reducing the noise and the shaking problem of the mechanism which drives the inner blades in reciprocating motion.

Then, the other important object of the present invention is to offer an electric shaver which makes it possible to augment the stroke of the inner blades via a simplified mechanism.

By the way, the prior art electric shaver connects the inner blades 130 to the shaver body 127 via the inner blade stages 128 and the blade support 132, and the outer blades 129 to the outer blade frame 107 an outer blade case 106 in a removable fashion. According to this electric shaver, when the outer blade case 106 is removed from the outer blade frame 107, the inner blades 130 remain on the inner blade stages 128 of the blade support 132 of the outer blade frame 107. For this reason, the outer blades 129 and the inner blades 130 cannot be removed together and therefore washed cleanly by immersion into a cleansing liquid such as a bubbling liquid or the like. On this account, in order to clean these parts by immersion into a cleansing liquid, it is necessary to remove the outer blade case 106 from the outer blade frame 107, and then remove the inner blades 130 from the inner blade stage 128. Therefore, this is a drawback because the cleaning procedure takes a significant amount of time.

In addition, it could happen that the inner blades 130, which are of a small size, can be dropped and lost when removed and then immersed into a cleansing liquid, or when cleaned by hand. Further, after the outer blade case 106 is removed, a safe cleaning of the metallic blades cannot be achieved because the inner blades 130 with numerous fairly thin metal blades are exposed. Furthermore, there is another drawback in that the thin metal sheets can be easily deformed and damaged.

The present invention has been further developed with the object to solve these drawbacks. The second important object of the present invention is to provide an electric shaver which will allow the inner blades to be connected to the outer blades with a fairly simplified structure, and thus permit easy and safe cleaning of both the inner blades and the outer blades at the same time.

Another important object of the present invention is to offer an electric shaver with inner blades which can be cleaned without being deformed and damaged.

The above and further objects and features of the invention will more fully be apparent from the following detailed description and accompanying drawings.

SUMMARY OF THE INVENTION

The electric shaver of the present invention comprises at least one outer blade, at least one inner blade moving with reciprocating motion relative to the inner side of the outer blade, and a driving mechanism which drives the inner blade in reciprocating motion. Further, the driving mechanism of the electric shaver of the present invention comprises at least one vibrating rod, which connects the inner blade at its ends and moves it in reciprocating motion, at least one vibrator, which connects the vibrating rod and is also mounted in a case allowing reciprocating motion, and a reciprocating motion mechanism, which moves the vibrator with reciprocating motion. The vibrating rod is associated to the inner blade by inserting its top into a drive port formed in the inner blade in such a manner that it can move in the direction along with the axis. Furthermore, each of the vibrating rods inserts a blade-pushing spring which pushes the inner blade toward the outer blade flexibly so that the inner blade moves in a vertical reciprocating motion.

The electric shaver of this structure connects the inner blades to the vibrating rods so that the inner blades can move in the direction of the axis. Therefore, unlike the related art, in this invention it is not necessary to apply a structure allowing up-down motion like an up-down rod for driving part for the inner blades. Furthermore, each of the vibrating rods comprises a blade-pushing spring which pushes the inner blade against the outer blade. The blade-pushing spring flexibly presses the inner blade against the inner face of the outer blade flexibly, and the inner blade is connected to the vibrating rod in a movable fashion in its axis direction. Accordingly, advantages of the invention are that the blade-pushing spring can be attached by a simple structure, and the inner blade can be pushed against the outer blades with a large stroke by means of a simplified mechanism comprising the vibrating rod and the blade-pushing spring.

The characteristics of the electric shaver having this structure are to simplify the driving mechanism driving the inner blade in reciprocating motion, to achieve mass production at a low cost, and also to reduce the noise and the shaking of the mechanism which drives the inner blades in reciprocating motion. This is because the driving mechanism of the electric shaver comprises at least one vibrating rod connecting the inner blade at its edge to allow the reciprocating motion, at least one vibrator which is connected to the vibrating rod and is mounted in a case allowing reciprocating motion, and a reciprocating motion mechanism moving the vibrators in reciprocating motion. In addition, the top of the vibrating rod is connected to inner blade by inserting it into a drive port formed in the inner blade. Furthermore, according to the electric shaver of the present invention, a vibrating rod inserted into a blade-pushing spring which pushes the inner blade to the outer blade flexibly, and the blade-pushing spring pushes the inner blade to the outer blade so the the top of the vibrating rod moves the inner blade in reciprocating motion. Because of this feature, this invention does not have driving parts for the inner blades to be movable up and down like an up-down rod. Therefore, the electric shaver of the present invention can make its driving mechanism, which drives the inner blades in reciprocating motion, to be so simple that it can be reduce the drawbacks such as noise, shaking, and the like effectively, and it also simplify its structure for the connection of the inner blades with the vibrators so that it reduces the number of its components, simplifies its assembly, and reduces its manufacturing cost. Furthermore, this invention has further advantages of pressing the inner blade against the outer blade with a large stroke by the simplified mechanism comprising the vibrating rod and the bladepushing spring.

Moreover, the electric shaver of the present invention in which the outer blades and inner blades can be easily cleaned mounts the inner blades so as to allow reciprocating motion at the inner side of the outer blades. Each of the outer blades is provided with a mesh cutter comprising a metal sheet which is opened with a number of beard cutting ports and curved in an arched-shape, and with a outer blade support which fixes the mesh cutter. The outer blade supports have facing plates which are mounted facing each other and fix the mesh cutter at the upper part. Each of the facing plates provide latches on an inner surface thereof, and the latches prevent the inner blades housed-in the outer blade from coming off. The inner blades are attached and removed together with the outer blades by the latches.

The electric shaver of this structure connects the inner blades to the outer blades with a fairly simplified structure, thereby allowing easy and cleaning of both the inner blades and the outer blades. This is because the electric shaver of the present invention has latches on the facing plates of each of the outer blade supports so that these latches hold the inner blades to prevent them from coming off. The latches can be easily produced in the manufacturing process of the facing plates. For example, the latches can be formed integrally with the facing plates in its production process. Therefore, the electric shaver with this easily produced structure can remove and attach the inner blades together with the outer blades.

The inner blades are removed together with the outer blades, in the condition in which the inner blades and the outer blades are still connected, for example, an electric shaver in which the inner blades are removed together with the outer blades, in the condition in which the outer blades and the inner blades remain in one unit, can be easily cleaned, simply by immersing the unit in a cleansing liquid such as a bubbling liquid or the like. The advantageous feature of the inner blades provides users with safe and easy cleaning of the inner blades since the metallic blade is not exposed when the inner blades are dismounted.

Finally, the blades of the inner blades which comprise thin metal sheets deform easily, however the electric shaver of the present invention can protect them by introducing the inner blades into the outer blade unit during cleaning so that deformation and damage of the metallic inner blades is prevented.

DETAILED DESCRIPTION OF THE INVENTION

Figure 1:
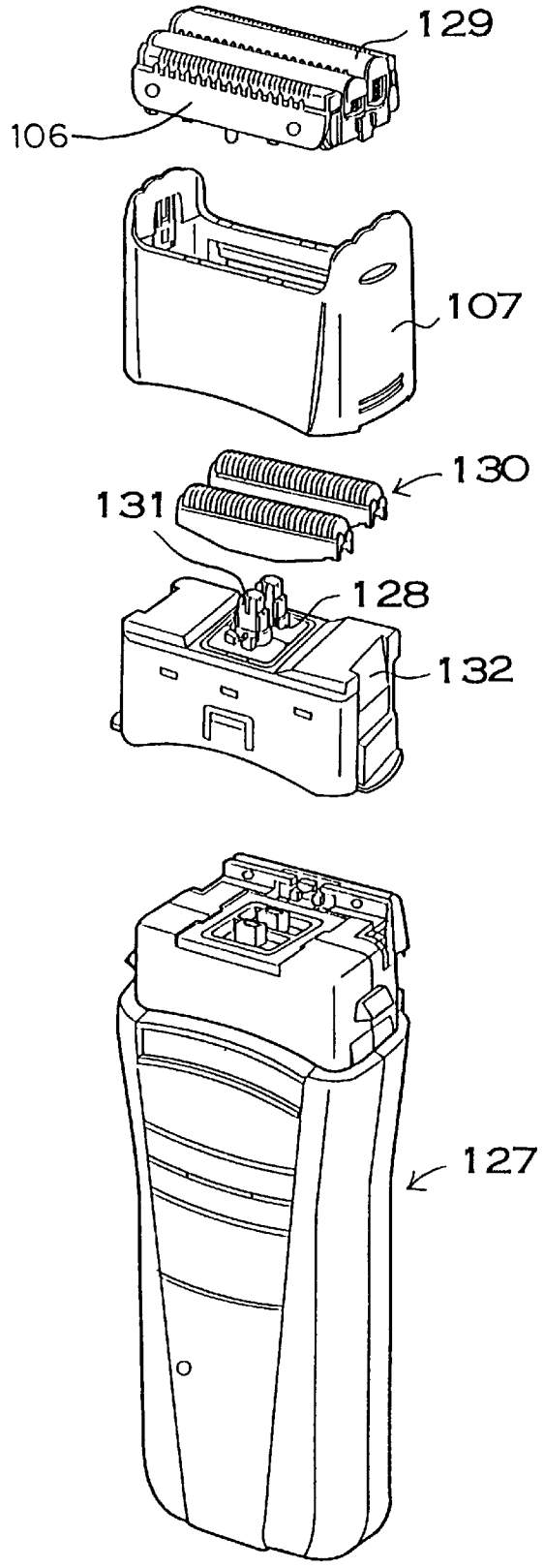
FIG. 1 (PRIOR ART)
FIG. 1 is an exploded oblique view of a known electric shaver.
Figure 2:
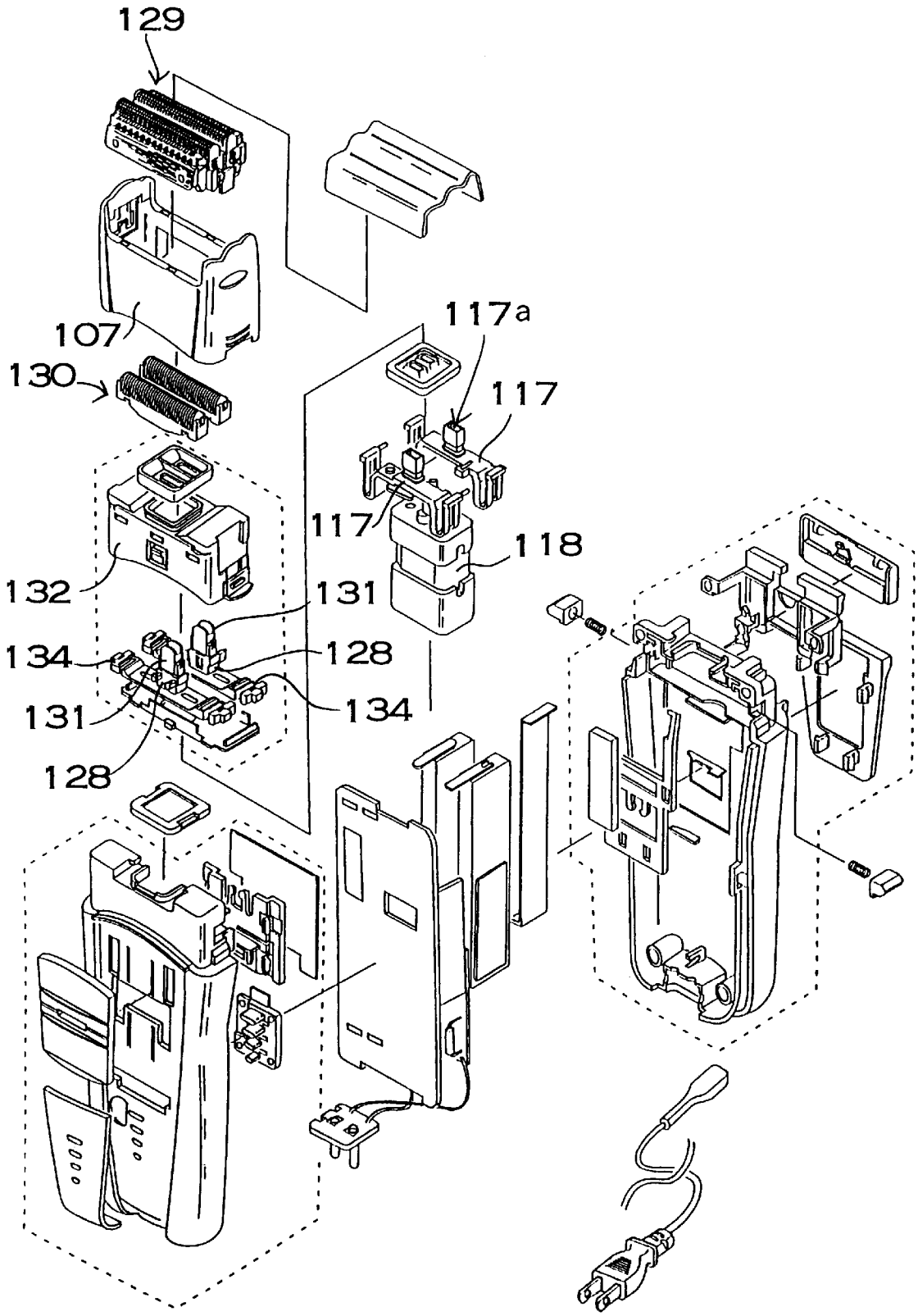
FIG. 2 (PRIOR ART)
FIG. 2 is an exploded oblique view of the shaver body of the electric shaver shown in FIG. 1.
Figure 3:
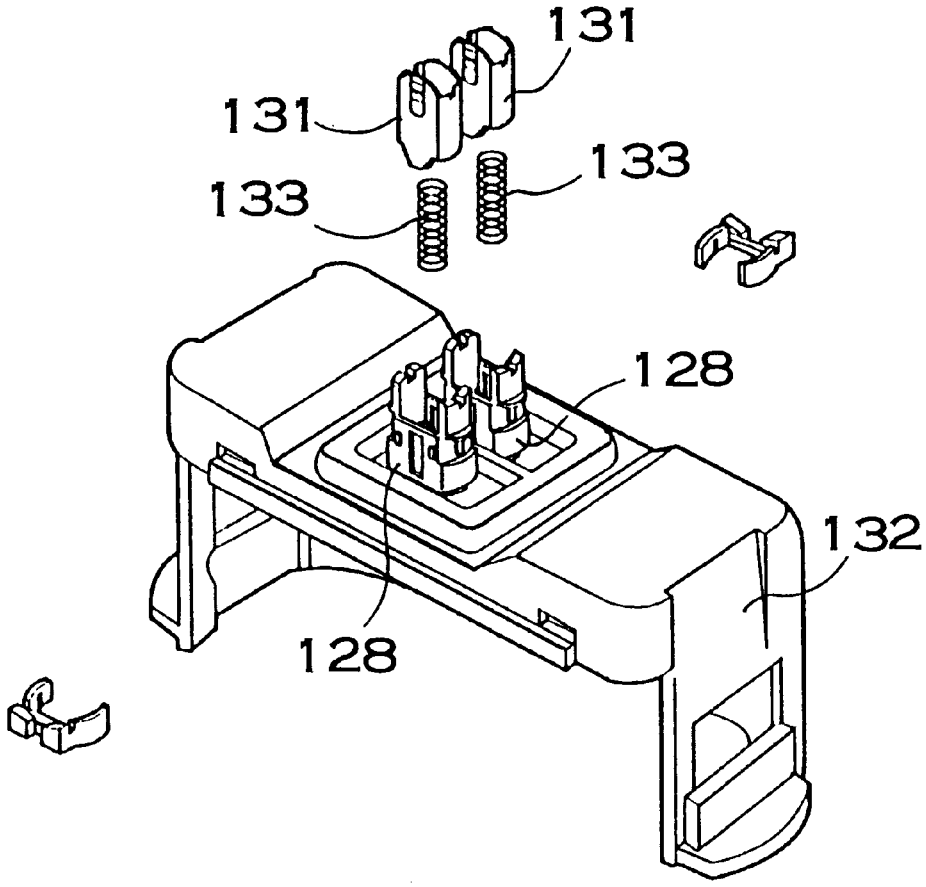
FIG. 3 (PRIOR ART)
FIG. 3 is an exploded oblique view showing the connecting structure of the inner blade stage and the up-down rods of the electric shaver shown in FIG. 1.
Figure 4:
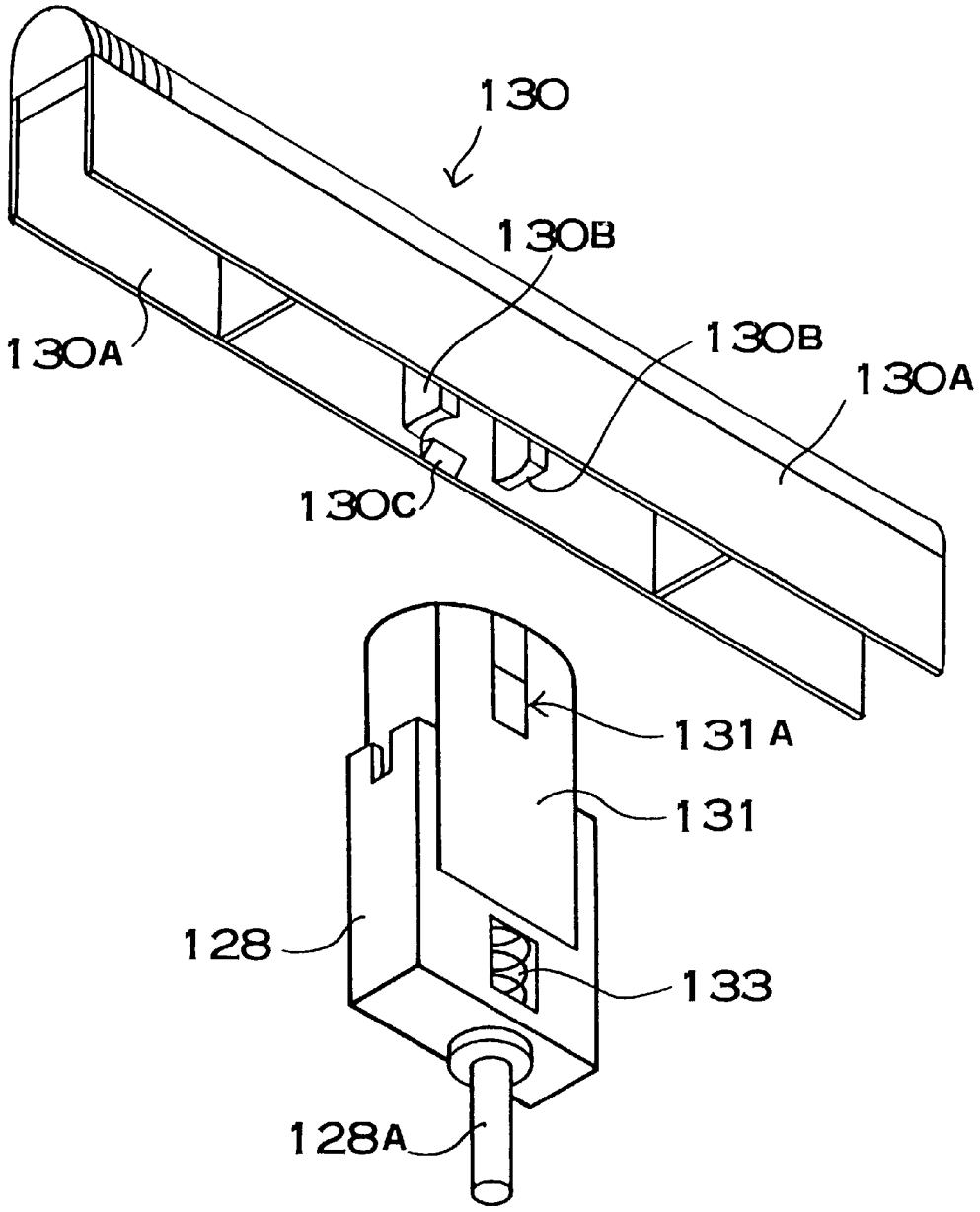
FIG. 4 (PRIOR ART)
FIG. 4 is an exploded oblique view showing the connecting structure of the inner blade and the up-down rod of the electric shaver shown in FIG. 1.
Figure 5:
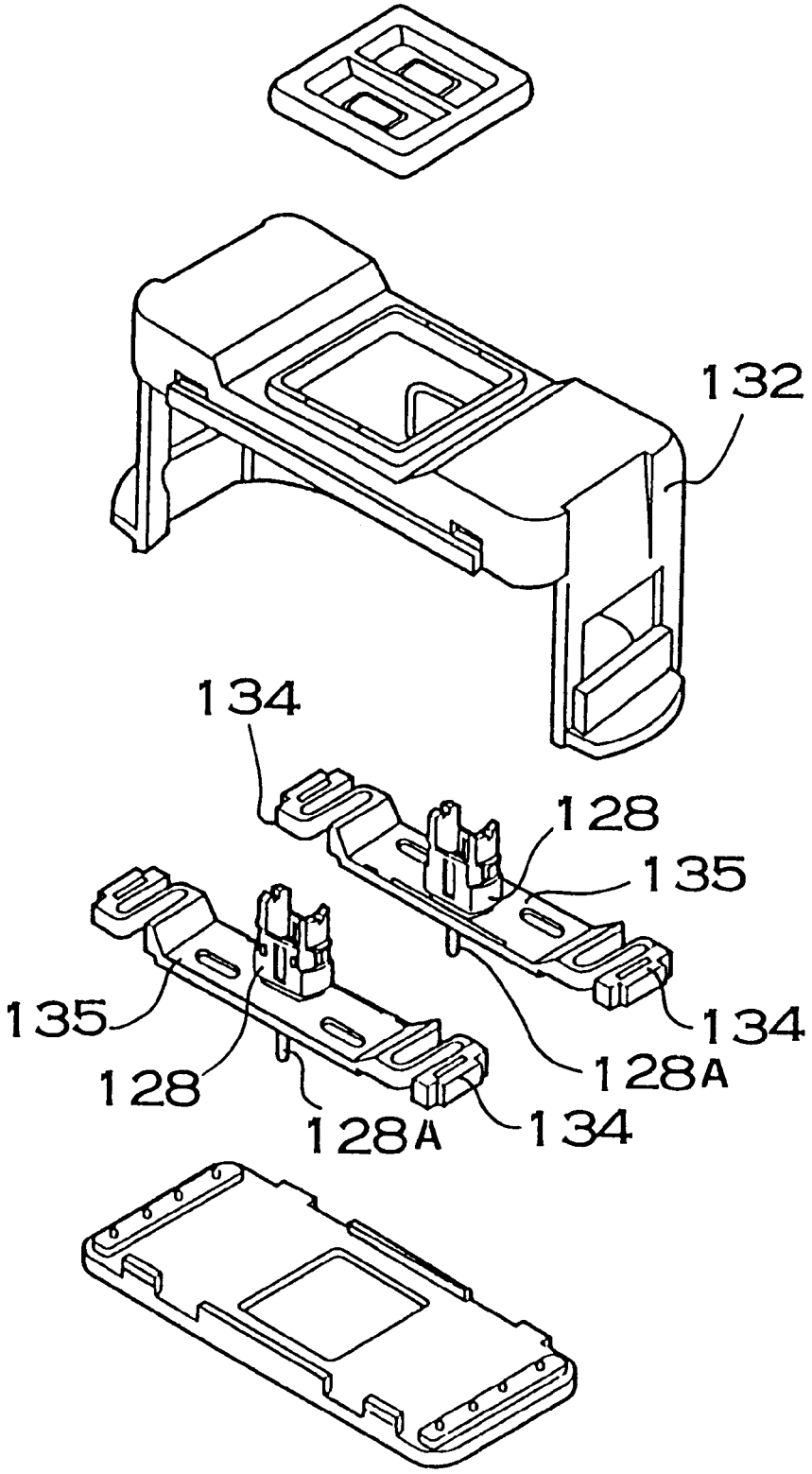
FIG. 5 (PRIOR ART)
FIG. 5 is an exploded oblique view of blade support shown in FIG. 3.
Figure 6:
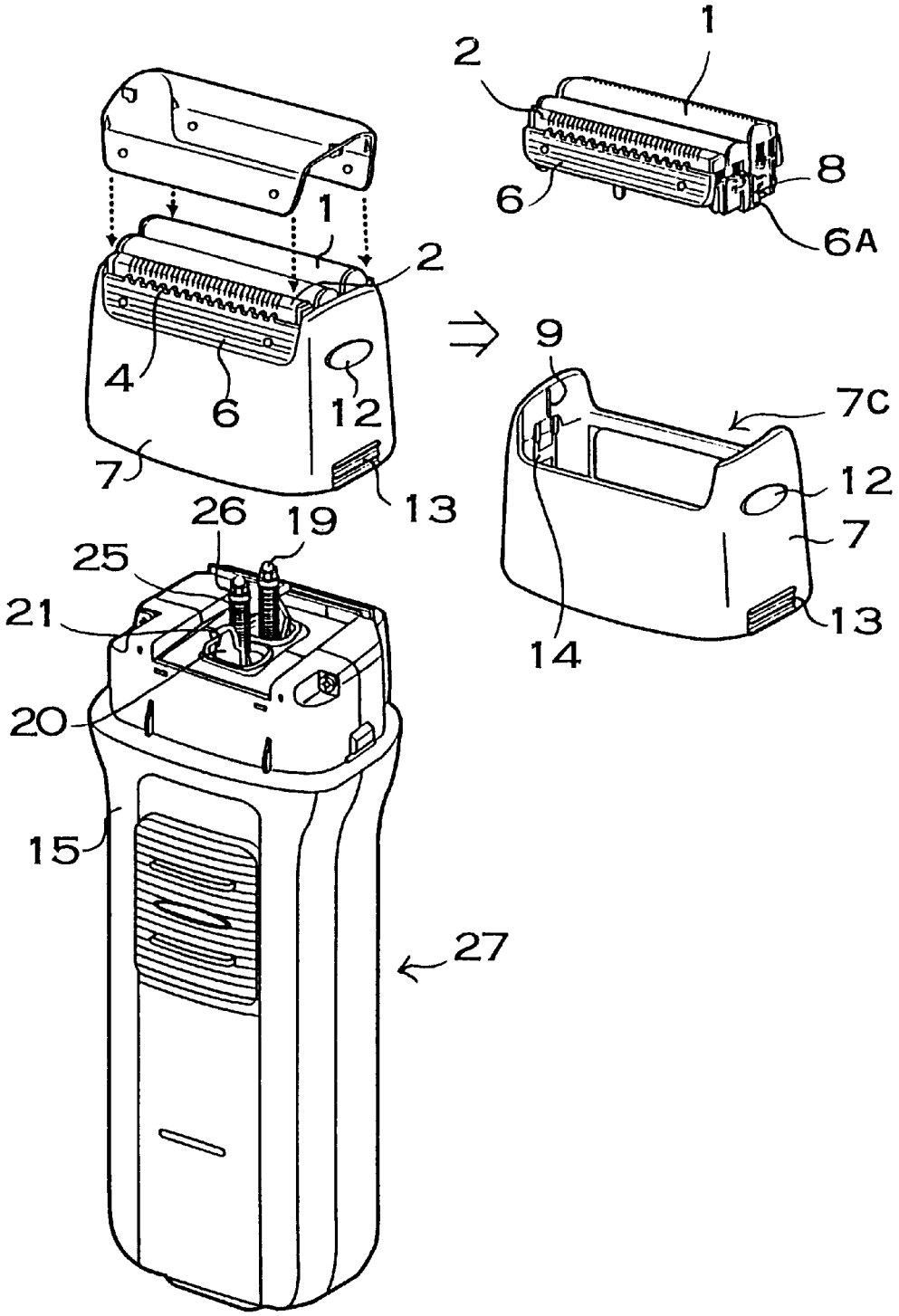
FIG. 6 is an exploded oblique view of the electric shaver of an embodiment of the present invention.
Figure 7:
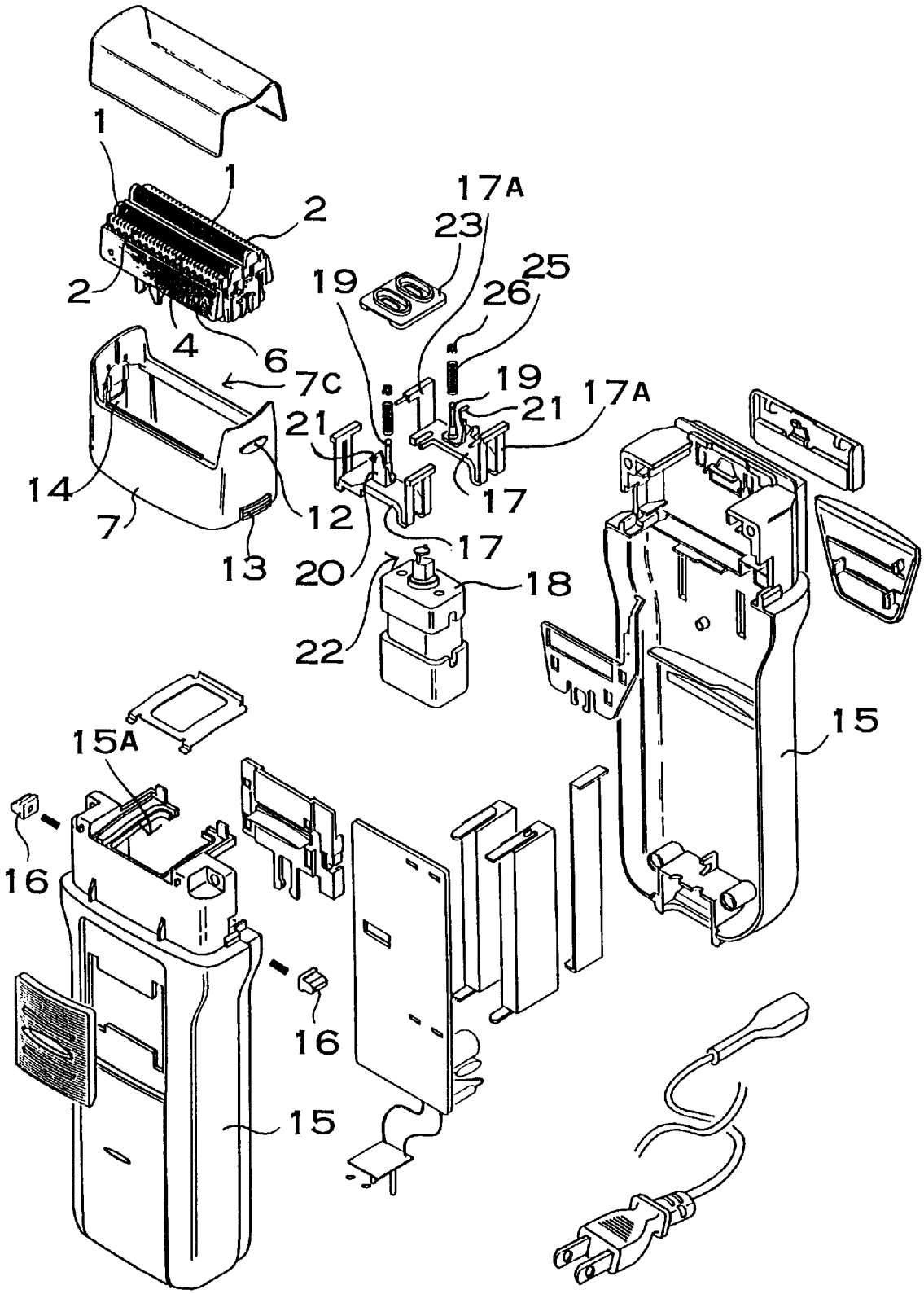
FIG. 7 is an exploded oblique view of the shaver body of the electric shaver shown in FIG. 6.

The electric shaver, shown in an exploded oblique views of FIG. 6 and FIG. 7, is provided with a shaver body 27, an outer blade case 6 which connects outer blades and inner blades, an outer blade frame 7 which not only mounts this outer blade case 6 in a removable fashion, but also mounts itself in a removable fashion on the shaver body 27, and a driving mechanism which drives the inner blades in reciprocating motion.

The electric shaver of FIG. 6 connects the outer blade frame 7 in a removable fashion to the shaver body 27. However, the outer blade frame may be fixed to the shaver body so that it cannot be removed, or it can be formed integrally with the shaver body (not illustrated).

The outer blade case 6 connects four rows of outer blades in parallel each other. The four rows of outer blades are composed of two rows of arched outer blades 1, and two rows of slit port outer blades 2 which are provided on both sides of these arched outer blades 1. The outer blade case 6 houses four inner blades at the inner face of the four rows of outer blades, respectively. Namely, the arched inner blades 3 are contained in the arched outer blades 1, and the slit inner blades 5 are contained in the arched outer blades 2.

In the illustrated electric shaver the outer blades can be removed with the inner blades housed in the outer blades, as the inner blades are connected to the outer blades. However, the electric shavers of the present invention, provided with plural outer blades and inner blades as illustrated, are not restricted to the removal structure with all inner blades to be removed with the outer blades connected together. For example, an electric shaver having four rows of outer blades may have a structure in which two rows of inner blades are removed together with outer blades, and the other two rows of inner blades are removed from the outer blades separately. The electric shaver having a structure in which the outer blade case is detached with all inner blades connected together with the outer blades will be the best one for convenient use. The electric shaver of the following described embodiment of the present invention can remove four rows of inner blades together with the outer blades. However, the slit inner blades of the embodiment are connected to the slit port outer blades with a different structure from the one of the arched blades. It is still possible to house the slit inner blades in the slit port outer blades with the same structure as the arched inner blades (not illustrated).

Figure 8:
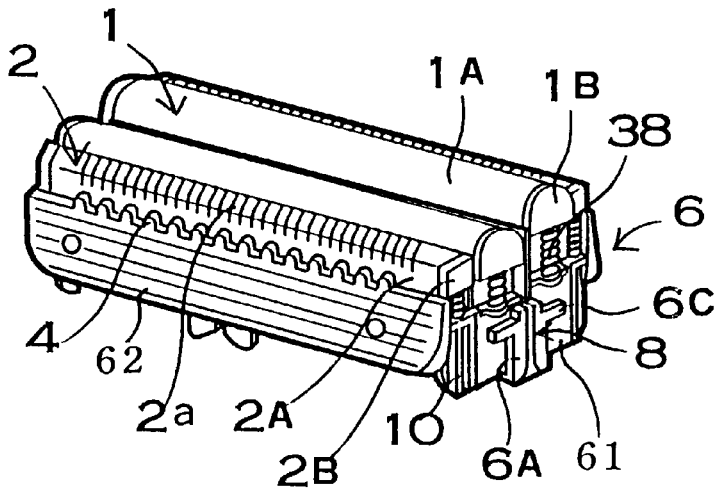
FIG. 8 is a magnified oblique view of an outer blade frame and an outer blade case of the electric shaver shown in FIG. 6.
Figure 8:
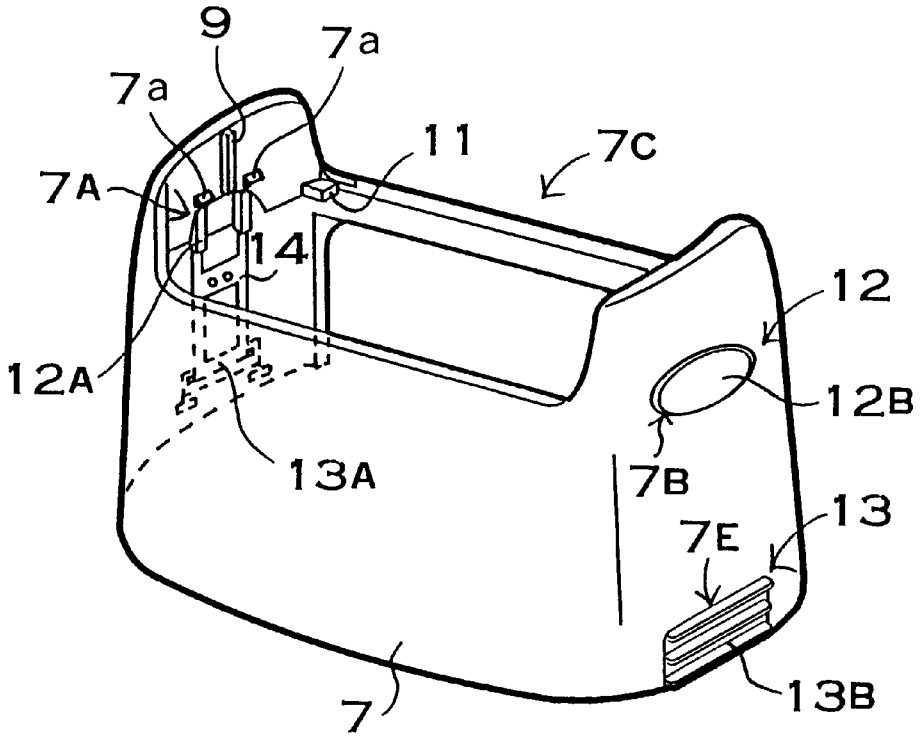

As shown in FIG. 8, the arched outer blades 1 fix a mesh cutter 1A curved with the shape of arch to an outer blade support 1B made of plastic. The mesh cutter 1A is opened with a great number of beard cutting ports (not illustrated). The outer blade support 1B is formed of plastic material in a shape of a rectangular cylinder, providing the mesh cutter 1A at its upper part. The outer blade support 1B has a pair of facing plates spaced apart and connected at both ends facing each other.

The slit port outer blades 2 have slit outer blade plates 2A fixed to the outer blade support 2B made of plastic. Each of the slit outer blade plates 2A comprises a metal sheet opened with a number of parallel slits **2*a* which extend in the transverse direction respectively. The slit outer blade plate 2A is formed by bending the metal sheet in a rectangular form having a planar upper face, and opened with the parallel slits 2*a***, each of which is opened in the upper face and is extended from the corner of the external face to the perpendicular side.

The electric shaver of the following described embodiment has a structure making the outer blade case removable from the outer blade frame in which the inner blades and the outer blades are connected together. Therefore, the outer blades, mounted in the outer blade case, house the inner blades, which move relative to the inner face of the outer blade with reciprocating motion. The inner blades are connected to the outer blades so as to prevent them from coming off the outer blade case when the outer blade case is detached from the outer blade flame.

The electric shaver with this structure achieves the characteristic that it provides very easy cleaning by simply immersing the removed outer blade case in a cleansing liquid, because the outer blades and the inner blades are mounted in the outer blade case.

Figure 9:
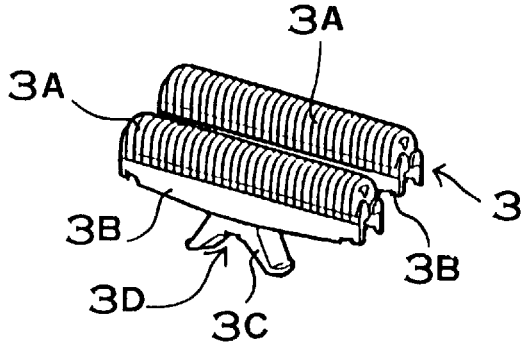
FIG. 9 is an oblique view of an arched inner blade of an embodiment of the present invention.

As shown in FIG. 9, the arched inner blades 3 are composed by inserting a plurality of arched metallic blades 3A disposed in parallel into inner blade support 3B which is formed of plastic. Each of the arched metallic blades 3A is made of metal sheet formed in a curve at its upper edge so as to accord with the inner face of the arched outer blade 1, which is curved in arched-shape. The inner blade support 3B of the arched inner blades 3 provides a connecting part 3C protruding downwards with an inverted-V-shape. The connecting part 3C, having a inverted-V-shape, is designed with a taper so as to get wider downwardly. The center of the connecting part 3C defines a vertical drive port 3D in which a flange 19A of the vibrating rod 19, driving the arched inner blade 3 in reciprocating motion (see FIG. 12), is inserted in order to move in the axis direction.

The electric shaver of this invention has the characteristic that the inner blades can be vibrated smoothly without latching with latches when the inner blades are pushed against the inner surface of the outer blades and moved in reciprocating motion, because the inner blades are housed in the outer blades allocating the inner blade support of the inner blades above the latch.

Figure 10:
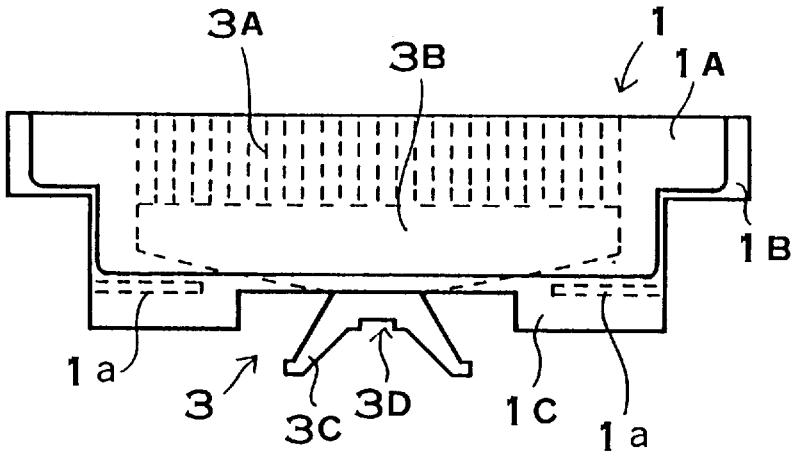
FIG. 10 is a front view showing the connection of the arched inner blade with the arched outer blade.
Figure 11:
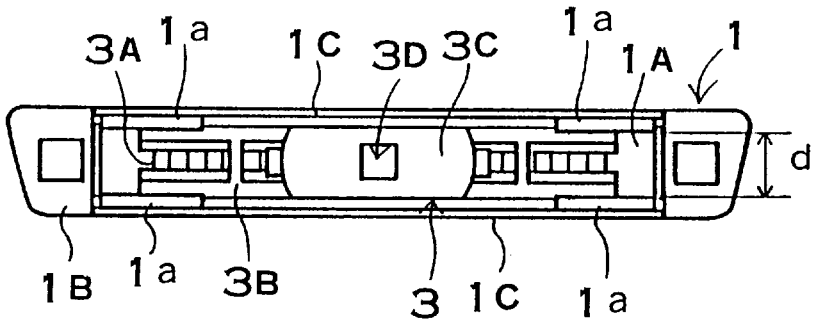
FIG. 11 is a bottom view of the arched outer blade shown in FIG. 10.
Figure 12:
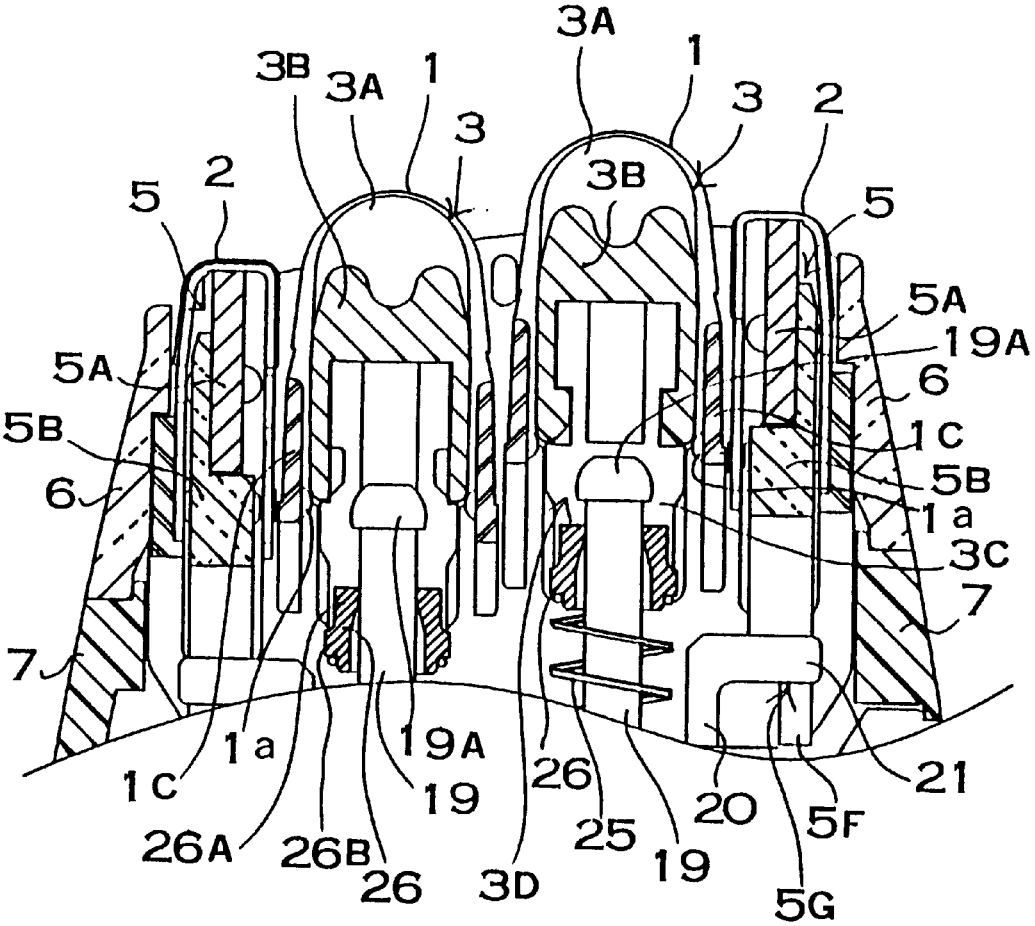
FIG. 12 is an expanded transverse cross-sectional view of the electric shaver shown in an embodiment of the present invention.

As shown from FIG. 10 to FIG. 12, the arched inner blades 3 are introduced into and connected with the arched outer blades. The arched outer blades 1 have latches 1*a*, each of which protrude at the inner face of the outer blade support 1B, and prevent the housed-in arched inner blades 3 from coming off, so that the arched inner blades 3 are detached together with the arched outer blades 1 due to the connection with the outer blade case 6 by means of the latches 1*a*. The arched outer blades 1 shown in FIG. 10 to 12, provide the latches 1*a* formed gibbously and integrally with and protruding at the inner face of the facing plate 1C. The latches 1*a* extend in the horizontal direction at both ends of the facing plate 1C. When the arched inner blades 3 are inserted in the arched outer blades 1, the latches 1*a* are positioned slightly lower than the inner blade support 3B of the arched inner blades 3. In other words, the inner blade support 3B of the arched inner blade 3 is positioned above the latches 1*a* to avoid a collision with the latches 1*a* when the arched inner blades 3 move in reciprocating motion relative to the inner face of the arched outer blades 1.

Figure 13:
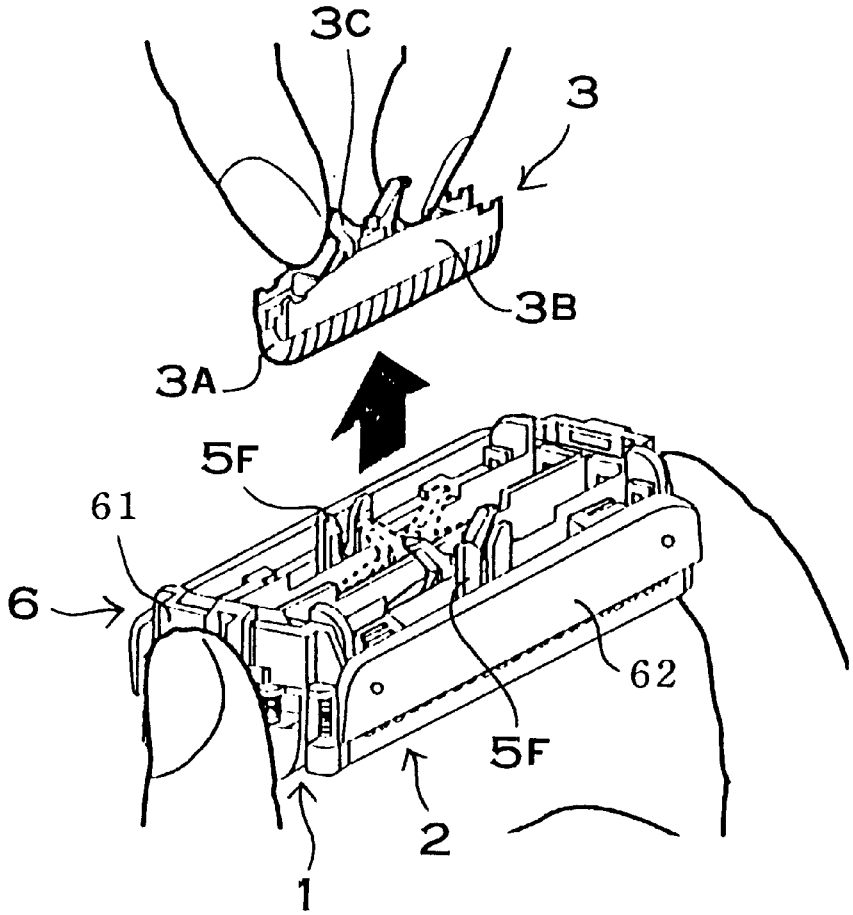
FIG. 13 is an oblique view showing the process of removing one of the arched inner blades from the archer outer blades shown in FIG. 10.

When removing the outer blade case 6 from the outer blade frame 7, the latches 1*a* maintain the arched inner blades 3 within the arched outer blades 1. The arched inner blades 3 are connected to the arched outer blades 1 so that they may be easily removed when necessary, as shown in FIG. 13. When the arched inner blades 3 are removed from the arched outer blades 1, the facing plates 1C deform flexibly, and the width (d) between the latches 1*a* provided in the opposing facing plates 1C, as shown in FIG. 10, gets wider, then the arched inner blades 3 pass through the widened width between latches 1*a*.

The electric shaver with this structure has the advantage that the inner blades can be easily removed from the outer blade support by simply deforming the facing plates, since the facing plates are made of elastically deformable plastic.

The shorter the length of the latches, the easier the arched inner blades 3 are removed from the arched outer blade 1. However, if the latches are too short, the space of the latches protruding on the facing plates opposing each other becomes wider than the length of the inner blade, and the arched inner blades would fall off the arched outer blades when removing the outer blade case from the outer blade frame. On the contrary, if the latches are too long, it would be more difficult to remove the arched inner blades, because it is necessary to significantly deform the facing plates. Therefore, preferably, the latches 1*a* should be set at a proper length allowing the arched inner blades 3 to be smoothly removed and attached when the outer blade case 6 is removed from the outer blade frame 7, thereby preventing the arched inner blades 3 from falling off.

Figure 14:
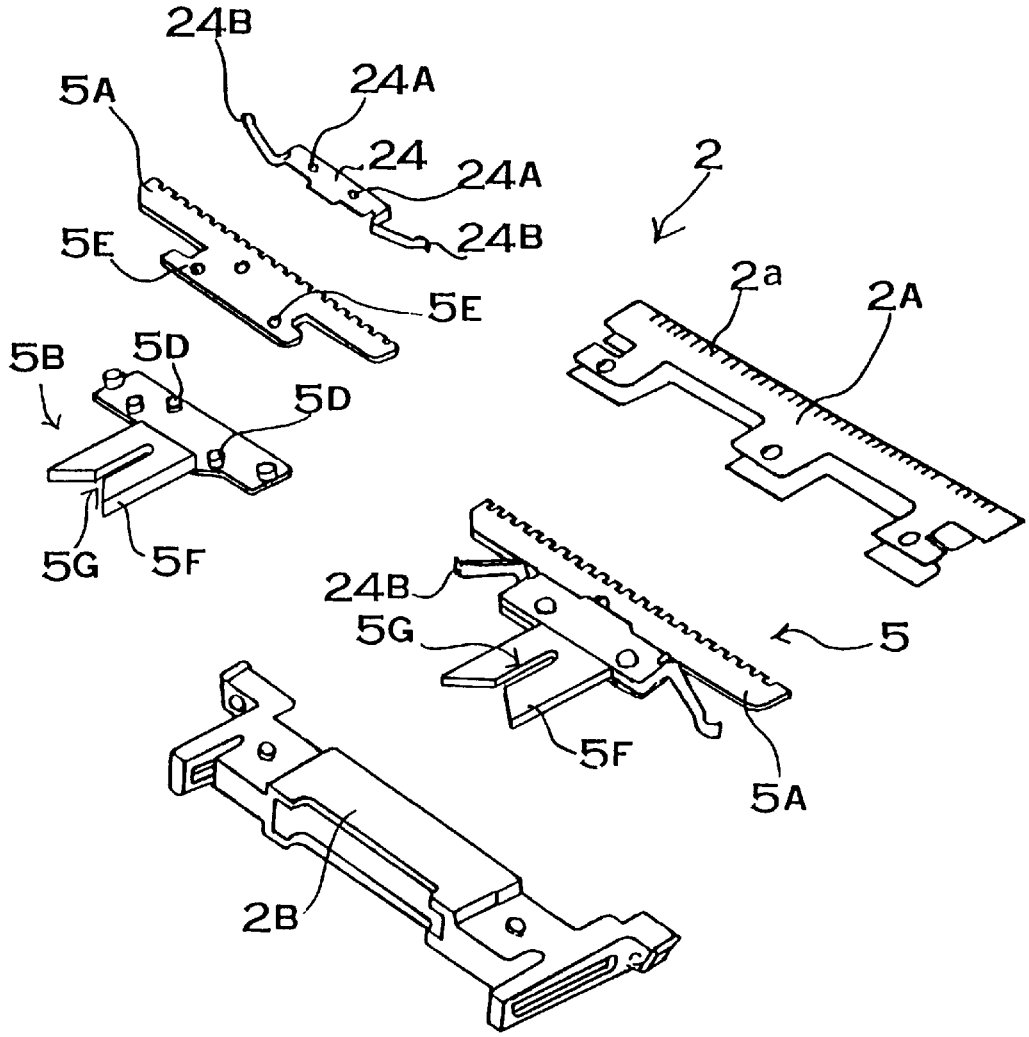
FIG. 14 is an exploded oblique view of the slit port outer blade shown in FIG. 8 with partial exploded view.

As shown in FIG. 14, the slit inner blade 5 is provided with slit metallic blade 5A which forms comb-like slits. The upper edge of the slit metallic blade 5A rubs against the inner face of the slit outer blade plate 2A to cut the beard that is led into the parallel slits 2*a* provided at the slit outer blade plate 2A. Each of the slit inner blades 5 is mounted inside the slit port outer blade 2 and driven in reciprocating motion by the vibrator 17.

The slit inner blade 5, for example, with the structure shown in the exploded oblique view of FIG. 14, can connect in the slit port outer blade 2. The slit inner blade 5 comprises a slit metallic blade 5A, a plastic inner blade support 5B and a blade-pushing leaf 24 which is a leaf spring. The slit metallic blade 5A and the blade-pushing leaf 24 are fixed and laminated on the inner blade support 5B. The inner blade support 5B is configured overall in a T-shape and is provided with a plurality of connecting tabs 5D located at predetermined positions to connect with the slit metallic blade 5A and the blade-pushing leaf 24. The slit metallic blade 5A forms connecting ports 5E at counterpart positions where the connecting tabs 5D of the inner blade support 5B are to be inserted.

The blade-pushing leaf 24 is press formed from a thin flexible metallic sheet, and forms connecting ports 24A at counterpart positions where the connecting tabs 5D provided on the inner blade support 5B are to be inserted, and provides inverted V shaped flexible pieces 24B which protrude outwardly on both sides. The flexible pieces 24B push the upper surface of the outer blade support 2B of the slit port outer blade 2 such that the slit metallic blade 5A is flexibly pushed against the inner surface of the slit port outer blade 2.

The slit inner blade 5 can easily be put together with the precise position by placing the slit metallic blade 5A and the blade-pushing leaf 24 on the inner blade support 5B and simply inserting the connecting tabs 5D into the connecting ports 5E, of the slit metallic blade 5A, and the connecting ports 24A, of the blade-pushing leaf 24, respectively. Under this condition, if the extremities of the connecting tabs 5D of the inner blade support 5B are heated and welded, then the slit metallic blade 5A and the blade-pushing leaf 24 are secured to the inner blade support 5B more securely. The T-shaped inner blade support 5B, connecting the slit metallic blade 5A and the blade-pushing leaf 24, is connected with the slit port outer blade 2 by inserting rod or flange portion 5F into the outer blade support 2B of the slit port outer blade 2.

After the inner blade support 5B is inserted into the outer blade support 2B, then the slit outer blade plate 2A, which is bent in rectangular shape, is connected to the outer blade support 2B, and the slit inner blade 5 is held at a predetermined position of the slit port outer blade 2. The inner blade support 5B, which connects the slit metallic blade 5A and the blade pressure leaf 24, has a thickness that is substantially the same as the interior width between the slit outer blade plate 2A in order that the inner blade support 5B is held at a prescribed position without slanting inside the slit port outer blade 2.

The arched outer blades 1 and the slit port outer blades 2 are mounted on the outer blade case 6 so that they flexibly move up and down independently. The outer blade case 6 mounts a sub case which mounts the arched outer blades 1. (See FIG. 15)

Turning to FIG. 12, two rows of the arched outer blades 1 and two rows of the slit port outer blades 2 are mounted on the outer blade case 6 so that they are independently movable up-and-down, i.e., in-and-out motion. As shown in the exploded oblique view of FIG. 15, the four rows of outer blades are mounted on the outer blade case 6 so as to be movable up-and-down. Therefore, the two rows of the arched outer blades 1 and two rows of the slit port outer blades 2 have up-down slits 36 at each end. Each of the up-down slits 36 guides a guide projection 37 which protrudes inwardly on the inner surface of the outer blade case 6.

The four rows of the outer blades are mounted on the outer blade case 6, thereby allowing up-and-down motion due to the up-down slits 36 and the guide projection 37. When the four rows of the outer blades move up-down independently, the up-down slits 36 slide up and down along the guide projections 37.

As shown in FIG. 8, there are two rows of the arched outer blades, in which the arched outer blades 1 of the front row protrudes higher than the arched outer blades in the back row, therefore the up-down slits 36 of the back row arched outer blade 1 extend more than the up-down slits 36 of the front row arched outer blade 1. The arched outer blade 1 with the longer up-down slits 36 protrude higher than the front row arched outer blade 1 due to in-and-out springs 38.

The four rows of outer blades are flexibly pushed out by the in-and-out springs 38 to the lower extremity of the up-down slits 36 contacting with the guide projections 37. In other words, it is possible to adjust the position of protruding arched outer blades 1 and slit port outer blades 2 by modifying the relative position of the up-down slits 36 and guide projections 37.

Figure 15:
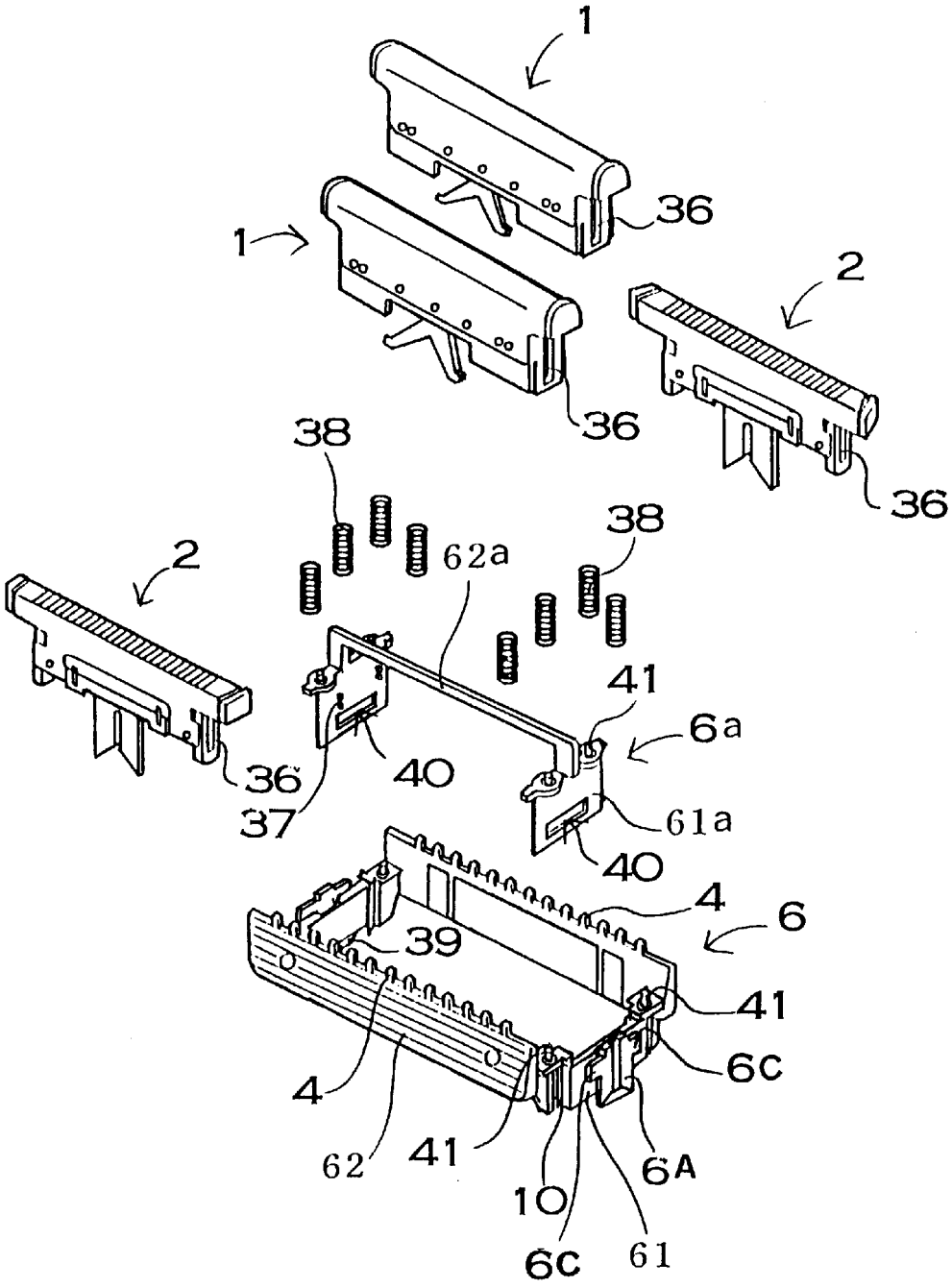
FIG. 15 is an exploded oblique view of the outer blade case shown in FIG. 8.

Turning to FIG. 15, the outer blade case 6 is provided with a sub case 6*a*. The sub case 6*a* is fitted on an inner surface of the outer blade case 6. As shown in FIG. 15, the sub case 6*a* comprises a pair of flexible plates 61*a*, and connecting rod 62*a* which connects these flexible plates 61*a* at both ends, and is formed integrally. The flexible plates 61*a* provide guide projections 37 on the inner surface facing each other to connect with the arched outer blades 1.

Each of the flexible plates 61*a* is configured with an overall shape to fit the inner surface of the outer blade case 6 at both sides. The flexible plates 61*a* form holes 40 at a lower portion, which receive latching flanges 39 provided on the outer blade case 6 to prevent the sub case 6*a* from coming off the outer blade case 6. The flexible plates 61*a* further provide connecting pins 41 that protrude at the top surface, an on which are inserted in-out springs 38 for pushing the arched outer blades 1 out. The connecting rod 62*a* takes on a thin plate shape in order to be located between the two rows of arched outer blades 1, and is connected at the upper portions of the flexible plates 61 a at either end, respectively.

The outer blade case 6 comprises opposite plates 61 and side plates 62 connecting both ends of the opposite plates 61, respectively. The outer blade case 6 is formed in a rectangular shape integrally of plastic. Therefore the outer blade case 6 has a rectangular shape configured to receive the sub case 6*a* inside. Each of the side plates 62 provides a comb 4 at the upper portion thereof.

Turning to FIG. 8, the outer blade case 6 is mounted in opening 7C in the upper end of the outer blade frame 7, in a removable fashion. The outer blade case 6 is connected at a predetermined position in the outer blade frame 7, thereby preventing the outer blade case 6 from falling off the outer blade frame 7. The outer blade case 6 is secured in outer blade frame 7 by latching pieces 6A and latching parts 7A. As shown in FIG. 8, the latching pieces 6A are provided on the opposing plates 61. The latching parts 7A are provided at the position where they can lead the latching pieces 6A to the proper positions so that the outer blade case 6 is mounted in a predetermined position in the outer blade frame 7. The latching parts 7A are two angled projections or salients 7*a* protruding from the inner surface of the outer blade frame 7. When the outer blade case 6 is mounted in the outer blade frame 7, the latching pieces 6A lock into the latching parts 7A, which are provided on the inner surface of the outer blade frame 7.

The latching pieces 6A protrude from both sides of the outer blade case 6, and extend vertically upward from the bottom. The latching pieces 6A flexibly deform and engage to the latching parts 7A of the outer blade frame. The latching pieces may be formed integrally of plastic with the outer blade case so as to forceable into the latching parts 7A due to the elastic property of the plastic material. Preferably, as shown in the cross-sectional view of FIG. 16, flexible metal sheet 6B is provided on the outer blade case 6. The flexible metal sheet 6B flexibly pushes the latching piece 6A into engagement with the latching part 7A.

The latching pieces 6A are T-shaped with a wider width at the upper portion. The end portion 6*c* of each T-shaped part are latched on the projection 7*a* which are the latching parts 7A provided on the outer blade frame 7 so that the outer blade case 6 is connected to the outer blade frame 7.

In order to easily connect the outer blade case 6 to the outer blade frame 7, each of the ends of the outer blade case 6 and the inner surfaces of the outer blade frame 7, which face the ends of the outer blade case 6, provides guides to lead the outer blade case 6 toward the direction of removing and attaching.

In the outer blade case 6 and the outer blade frame 7 shown in FIG. 8, the guides comprise guide grooves 8 provided on both of the outer surfaces of the outer blade case 6 and the guide rails 9 provided on both of the inner surfaces of the outer blade frame 7 so as to slide along the guide grooves 8. The guide grooves 8 extend along an up and down direction at the center portion of the latching pieces 6A and are formed integrally with the outer blade case 6. Each of the guide grooves 8 has a wider width at a lower end thereby providing tapered surfaces that smoothly guide the guide rails 9.

The guide rails 9 extend along an up and down direction at the inner surface of both facing sides of the outer blade frame 7, and are formed integrally with the outer blade frame 7. The outer blade frame 7 is integrally formed of metal or plastic material. The guide rails 9 are positioned so as to extend from the latching parts 7A to the upper end.

In addition, the outer blade case 6 shown in FIG. 8 mounts four rows of outer blades asymmetrically. The outer blade case 6 with this configuration needs to be connected to the outer blade frame 7 in a predetermined position. In order to prevent an adverse connection of the outer blade case 6 with the outer blade frame 7, a stopper mechanism is provided at the outer blade case 6 and the outer blade frame 7.

The stopper mechanism is composed of stopper rib 10, provided on the outer blade case 6, and a stopping flange 11 provided on the outer blade frame 7. The stopper rib 10 extends in an up and down direction at one corner of one side of the outer blade case 6. According to the FIG. 8, the stopper rib 10 is positioned at the front corner of the side face of the outer blade case 6. The stopping flange 11 protrudes inside of another corner of the outer blade frame 7 where the stopping flange 11 collides with the stopper rib 10 in the event that the outer blade case 6 is incorrectly inserted in the outer blade frame 7.

When the outer blade case 6 is inserted into the outer blade frame 7 in the posture shown in FIG. 8, i.e., when the outer blade case 6 is introduced in its normal posture into the outer blade frame 7, the stopper ribs 10 do not collide with the stopping flange 11 and the outer blade case 6 can be inserted and connected to the outer blade frame 7. However, if it is attempted to introduce into the outer blade frame 7 in an adverse position relative to the posture shown in FIG. 8, i.e., in a posture in which the outer blade case is rotated horizontally 180 degrees, the stopper rib 10 collides with the stopping flange 11. Therefore, the outer blade case 6 cannot be inserted into the outer blade frame 7 in a wrong direction.

The outer blade frame 7 provides latch releases 12 for detaching the outer blade case 6 from the outer blade frame 7. The outer blade case 6 is removed from the outer blade frame 7 by pressing the latch releases 12. The latch releases 12 are formed integrally with latch buttons 13 to release the outer blade frame 7 from the shaver body 27. The latch release 12 and the latch buttons 13 are made in single unit. The latch release 12 and the latch buttons 13 are composed of a flexible piece 14, which is made of elastically deformable plastic or metal material. The flexible piece 14 has a middle portion that connects to the outer blade frame 7, an upper portion that forms the latch release 12, and a lower portion that forms the latch button 13.

Each of the flexible pieces 14 has a laminated shape overall and is attached at its middle portion to the outer blade frame 7 so that the latch release 12 of the upper portion and the latch button 13 of the lower portion can elastically deform. The latch release 12, which is the upper portion of the flexible piece 14, is formed integrally with vertically extended pressure rods 12A which push both ends of the T-shaped latching piece 6A.

The latch release 12 is also formed integrally with outer blade button 12B which outwardly protrudes from the outer blade frame 7. The outer blade button 12B is inserted in hole 7B of the outer blade frame 7.

Figure 16:
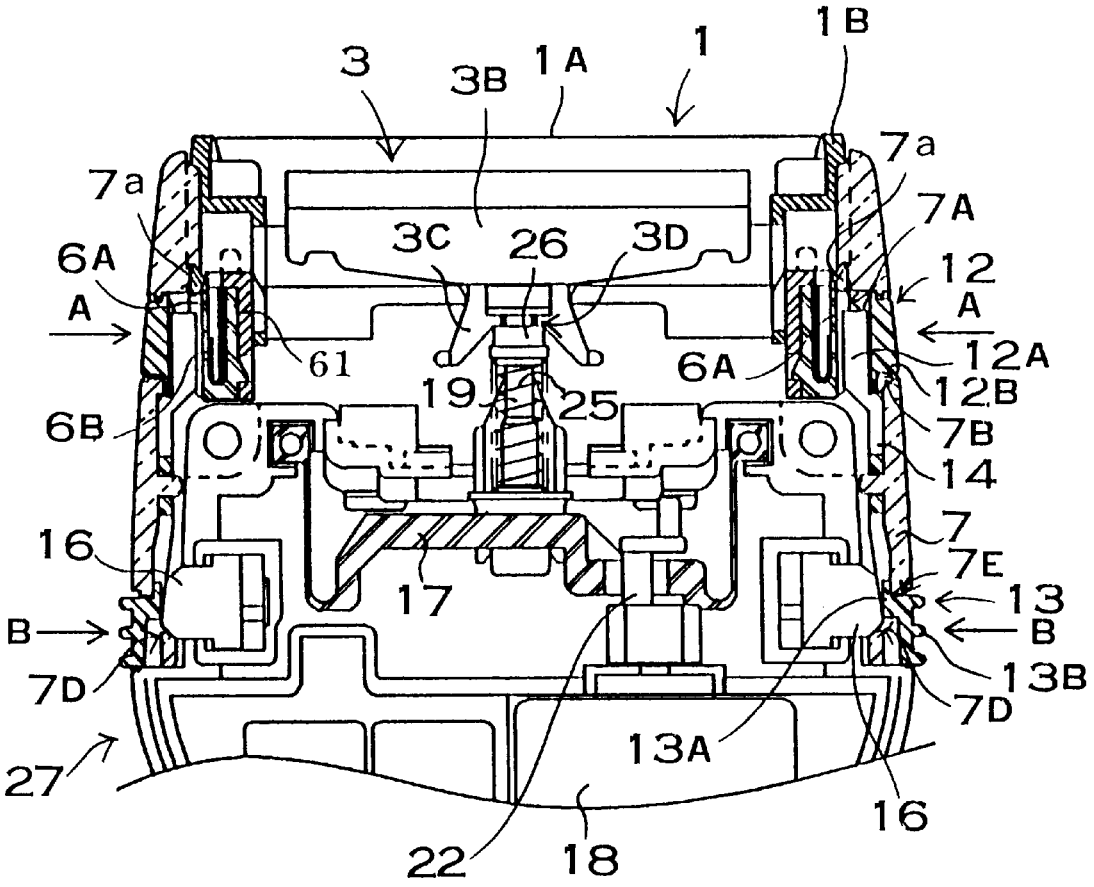
FIG. 16 is a longitudinal cross-sectional view of the electric shaver shown in FIG. 12.
Figure 17:
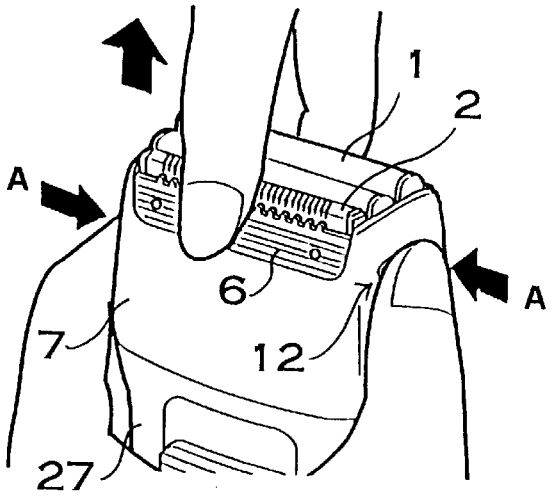
FIG. 17 is an oblique view showing the process of removing the outer blade case from the outer blade frame.

When the outer blade case 6 is detached from the outer blade case 7, the outer blade buttons 12B are pushed as shown by the arrows in FIG. 16 and in FIG. 17. After the outer blade buttons 12B are pushed in, the pressure rods 12A push the latching pieces 6A out of the latching parts 7A to release the latched state of the outer blade case 6 with the outer blade frame 7, then the outer blade case 6 can be removed from the outer blade frame 7.

The latch buttons 13 are provided with pressure rods 13A, which push in flexible knobs 16 (shown in FIG. 16) protruding from the shaver body 27, and frame button 13B protruding outside of the outer blade frame 7. The flexible knobs 16 are flexibly pushed out of the shaver body 27 and latched in latching grooves 7D provided on the inner surface of the outer blade frame 7 to connect the outer blade frame 7 on the shaver body 27. The frame buttons 13B are inserted in holes 7E formed on the outer blade frame 7, and protrude outside of the outer blade frame 7.

Figure 18:
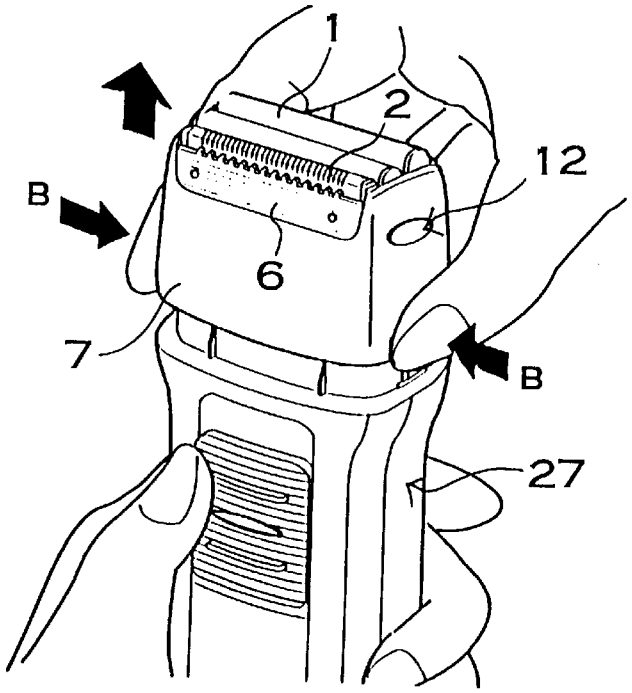
FIG. 18 is an oblique view showing the process of removing the outer blade frame from the shaver body.

To detach the outer blade frame 7 from the shaver body 27, as shown by the arrows of FIG. 16 and FIG. 18, the frame buttons 13B are pressed in. When the frame buttons 13B are pressed in, the flexible plates 13A push the flexible knobs 16 out of the latching grooves 7D then the flexible knobs 16 are no longer latched in the latching grooves 7D of the outer blade frame 7. Consequently, in this condition, the outer blade frame 7 is removed from the shaver body 27.

The arched inner blades 3, mounted in the outer blade case 6, move in reciprocating motion due to the connection with the vibrating rods 19, which protrude at the upper end of the shaver body 27. Two vibrating rods 19 move with reciprocating motion by being fixed to the vibrators 17 mounted in the body case 15 of the shaver body 27 in a manner which will allow reciprocating motion. The vibrators 17 are mounted in the body case 15 to allow reciprocating motion via the flexible arms 17A. These vibrators 17 are moved in reciprocating motion by cam shaft 22 fixed on the revolving axis of the motor 18. The vibrators 17 are provided with connecting slits 17B connecting the cam shaft 22 in a direction that is perpendicular to the vibrating direction. The revolving cam shaft 22 rubs the connecting slits 17B and drives the vibrators 17 in reciprocating motion. Two rows of vibrators 17 are connected to the cam shaft 22 with a phase difference of 180 degrees, and thus vibrate in opposite directions relative to each other.

The vibrating rods 19 are fixed vertically on the vibrators 17, and protrude from the shaver body 27. The vibrating rods 19 also protrude outwardly from upper opening 15A of the body case 15. The opening 15A is sealed by a rubber packing 23 as shown in FIG. 7, to avoid contamination such as dust or beard into the body case 15. The rubber packing 23 seals between the opening 15A and the vibrating rods 19, with its periphery seated at the inner surface of the opening 15A and its inner face seated on the periphery of the vibrating rods 19. The rubber packing 23 is formed of rubber material that is flexible and deformable so as to seal the space between the vibrating rods 19 and the opening 15A with no gap while allowing the vibrating rods 19 freely vibrate.

Figure 19:
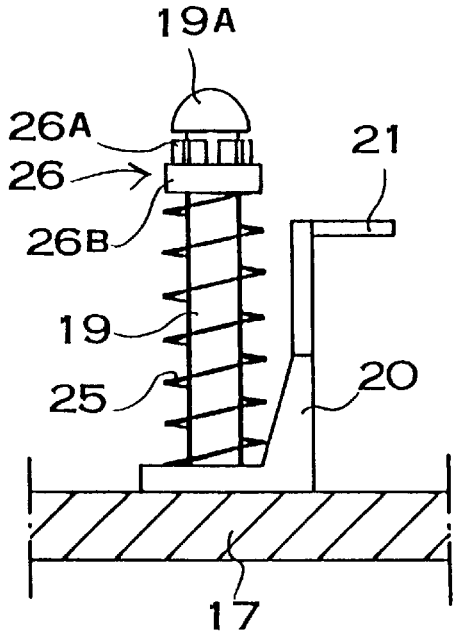
FIG. 19 is a partial transverse cross-sectional view of a vibrator shown in FIG. 7.

The vibrating rods 19 are metallic rods fixed vertically onto the vibrators 17 as shown in FIG. 19. Each of the vibrating rods 19 is formed with a bulky top to provide a flange 19A. The vibrating rod 19 inserts in blade-pushing springs 25 without coming off. A plastic latch ring 26 is introduced at the extremity of each of the blade-pushing springs 25. The latch ring 26 itself is secured by the flange 19A and prevents the blade-pushing spring 25 from coming off the vibrating rod 19.

Figure 20:
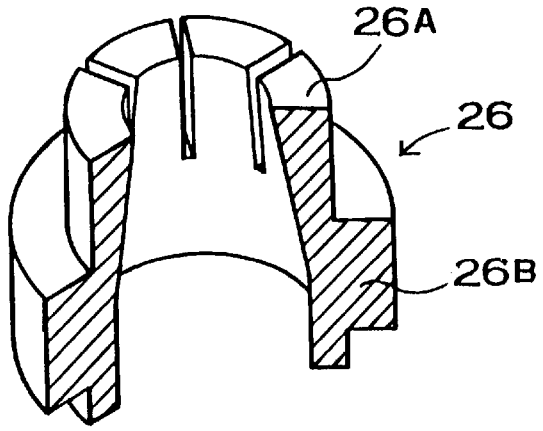
FIG. 20 is a partial transverse cross-sectional view of a latch ring shown in FIG. 19.

As shown in the oblique view of FIG. 20, the latch ring 26 has flexible nipping pieces 26A which flexibly deform in the direction of the axis of its central bore. When the latch ring 26 is inserted onto the vibrating rod 19, the flexible nipping pieces 26A open widely. Upon insertion onto the vibrating rod 19, the flexible nipping piece 26A latches the flange 19A of the vibrating rod 19 so as to avoid coming off the vibrating rod 19.

Each of the latch rings 26 is formed integrally of plastic and is composed of a flanged rib 26B at a lower portion and plural flexible nipping pieces 26A extending upwardly from the flanged rib 26B. To insert the vibrating rod 19 into the latch ring 26, the flanged rib 26B has an inner diameter larger than the outer diameter that is of the flange 19A. Further, the inner diameter of central bore formed by the plural flexible nipping pieces 26A is smaller than the outer diameter of the flange 19A to prevent the vibrating rod 19 from coming off following insertion. The latch ring 26 is easily inserted onto the vibrating rod 19 simply by opening widely by means of the flange 19A, when inserting the latch ring 26 on the vibrating rod 19 with the flanged rib 26B portion first. After insertion, the flexible nipping pieces 26A latch under the flange so that falling off is prevented.

The present invention with this structure has the advantage of preventing the pressure springs, inserted onto the vibrating rods, from coming off by a simplified structure. This is because the flange is provided at the end of the vibrating rod being thicker and the blade-pushing spring is held by inserting the latch ring onto the end of the vibrating rod. The structure is a fairly simplified structure which can effectively prevent the coming off of the blade-pushing spring from the vibrating rod.

Furthermore, the electric shaver of present invention flexibly pushes the inner blades against the inner surface of the outer blades by the latch rings which are pushed by the blade-pushing springs. The advantage of this structure is to simplify the connecting structure of the inner blades by using latch rings both as parts which prevent the blade-pushing springs from coming off and also as parts which flexibly push the inner blades against the inner face of the outer blades.

Second, the electric shaver with this structure has another characteristic to efficiently prevent the latch rings from coming off from the vibrating rods. This is because the latch rings of this structure have the flexible nipping pieces which elastically deform in the direction toward the axis of the central bore. These latch rings can be inserted on the vibrating rods by widening the flexible nipping pieces and can also be protected-from falling off from the vibrating rods by the flexible nipping pieces latched with the flanges when inserted. For this reason, the latch rings are secured to the vibrating rods without coming off.

Third, the electric shaver of this structure has not only the feature of easily and simply connecting the latch rings by inserting them on the vibrating rods, but also the feature of reliably preventing the latch rings from coming off of the vibrating rods. This is because the latch ring provides the flanged rib at its lower portion and plural flexible nipping pieces which extend upwardly from the flanged rib, and also because the inner diameter of the flanged rib is larger than the outer diameter of the flange, and the inner diameter of the central bore surrounded by the plural flexible nipping pieces is smaller than the outer diameter of the flange. The latch ring of this structure can be easily inserted on the vibrating rod, and also surely prevented from coming off of the vibrating rod due to the plural flexible nipping pieces which form smaller inner diameter relative to the outer diameter of the flange.

The vibrating rods 19 of this structure are inserted into the inner blade supports 3B of the arched inner blades 3 so as to drive the inner blade support 3B in reciprocating motion. The flange 19A of vibrating rod 19 is inserted into the drive ports 3D provided on the connecting part 3C of the inner blade support 3B of the arched inner blade 3 to drive each arched inner blade 3 in reciprocating motion.

As shown in FIG. 12 and FIG. 16, the latch ring 26 pushed up against the tapered face of the connecting part 3C to flexibly push the arched inner blades 3 against the inner surface of the arched outer blades 1. The tapered face of the connecting part 3C leads the latch ring 26 into the central portion without creating any gaps. According to this structure, when the flanges 19A of the connecting rods 19 are inserted into the drive ports 3D, the inner blades are driven in reciprocating motion by means of the flanges 19A and the drive ports 3D, and the latch rings 26 and the connecting parts 3C push the inner blades against the outer blades by pushing the latch ring 26 against the tapered face. Thus, driving the inner blades in reciprocating motion can be performed by using the vibrating rods 19 which, lightly push the arched inner blades 3 against the inner faces of the arched outer blades 1.

This invention still has the advantage of surely guiding the vibrating rods into the drive ports of the inner blades even if the vibrating rods connecting the inner blades are inserted while slightly out of alignment, since the connecting part, which connects the vibrating rods to the inner blade support of the inner blades, is formed with a tapered lower surface. Besides, using this connecting part, the inner blades are pushed against the inner surface of the outer blades in an ideal condition due to the tapered part guiding the latch rings toward its center portion. Moreover, the connecting parts also simplify the structure because they serve as the parts which push the inner blades against the inner faces of the outer blades.

Finally the vibrator 17 is formed of plastic integrally with vibrating arm 20 (shown in FIG. 7) which drives the slit inner blades 5 in reciprocating motion. The vibrating arm 20 horizontally provides driving rod 21 which is introduced into driving slit 5G (shown in FIG. 14) provided at the lower portion of the inner blade support 5B of the slit inner blade 5. When inserted into the driving slit 5G of the inner blade support 5B of the slit inner blade 5, the driving rod 21 drives the slit inner blade 5 in reciprocating motion.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, of equivalence of such metes and bounds thereof are therefore intended to be embraced by the claims.

What is claimed is:

1. An electric shaver comprising:

a case;

at least one outer blade;

at least one inner blade movable in a reciprocating motion relative to an inner face of said outer blade, said inner blade having a drive port; and a driving mechanism for driving said inner blade in reciprocating motion, said driving mechanism comprising:

(a) at least one vibrating rod having a rod portion and a flange formed at an end of said rod portion, said flange having a larger diameter than a diameter of said rod portion, wherein said flange is inserted into said drive port of said inner blade so as to allow said inner blade to be moved along an axis of said vibrating rod;

(b) a blade-pushing spring mounted on said vibrating rod, said blade-pushing spring acting to flexibly push said inner blade against said outer blade;

(c) a latch ring provided on said vibrating rod, said latch spring being disposed between said flange and said blade-pushing spring;

(d) at least one vibrator disposed in said case and connected to said vibrating rod; and (e) a reciprocating motion mechanism for driving said vibrator in reciprocating motion.

2. An electric shaver as claimed in claim 1, wherein said latch ring prevents said blade-pushing spring from coming off of said vibrating rod.

3. An electric shaver as claimed in claim 1, wherein said latch ring flexibly engages and pushes said inner blade due to a biasing force of said blade-pushing spring acting on said latch ring.

4. An electric shaver as claimed in claim 1, wherein said latch ring comprises a latch ring bore, and at least one elastically deformable nipping piece defining a reduced diameter portion of the latch ring bore, and wherein said vibrating rod is inserted through the latch ring bore by deforming said nipping piece.

5. An electric shaver as claimed in claim 1, wherein said latch ring comprises at least one flexible nipping piece engaged under said flange of said vibrating rod to prevent said latch ring from coming off of said vibrating rod.

6. An electric shaver as claimed in claim 1, wherein said latch ring comprises:

a flanged rib provided at a lower portion thereof; and a plurality of flexible nipping pieces provided around and extending upwardly from said flanged rib, wherein an inner diameter of said flanged rib is larger than an outer diameter of said flange of said vibrating rod, and an inner diameter of a bore formed by said flexible nipping pieces is smaller than the outer diameter of said flange of said vibrating rod.

7. An electric shaver as claimed in claim 1, wherein said inner blade comprises an inner blade support having an inverted V-shaped connecting part.

8. An electric shaver as claimed in claim 7, wherein said connecting part defines the drive port of said inner blade.

9. An electric shaver as claimed in claim 8, wherein said connecting part provides angled surfaces for guiding said flange of said vibrating rod into the drive port.

10. An electric shaver as claimed in claim 1, wherein said outer blade comprises at least one arched outer blade and at least one slit port outer blade, and said inner blade comprises at least one arched inner blade movable in reciprocating motion relative to an inner face of said arched outer blade, and at least one slit inner blade movable in reciprocating motion relative to an inner face of said slit port outer blade.

11. An electric shaver as claimed in claim 10, wherein said vibrator comprises a vibrating arm which is integrally formed of plastic.

12. An electric shaver as claimed in claim 1, further comprising at least one outer blade support structure supporting said outer blade, said outer blade support structure including a pair of opposing facing plates, and a plurality of latches formed on an inner surface of said facing plates, wherein said latches prevent said inner blade from being displaced from said outer blade so that said inner and outer blades can be detached together from said vibrating rod.

13. An electric shaver as claimed in claim 12, wherein said facing plates are formed of elastically deformable plastic so that said inner blade can be detached from and attached to said outer blade support structure by deforming said facing plates.

* * * * *